US012188675B2

(12) United States Patent
Boyd et al.

(10) Patent No.: US 12,188,675 B2
(45) **Date of Patent: *Jan. 7, 2025**

(54) SYSTEMS AND METHODS FOR OPERATING AN HVAC SYSTEM

(71) Applicant: Tyco Fire & Security GmbH, Neuhausen am Rheinfall (CH)

(72) Inventors: Andrew Michael Boyd, Wichita, KS (US); Theresa Thy Nguyen Gillette, Wichita, KS (US); Mason Sloan Dewald, Wichita, KS (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/369,611

(22) Filed: Sep. 18, 2023

(65) Prior Publication Data

US 2024/0003578 A1 Jan. 4, 2024

Related U.S. Application Data

(63) Continuation of application No. 17/541,083, filed on Dec. 2, 2021, now Pat. No. 11,761,661.

(51) Int. Cl.
*F24F 11/65* (2018.01)
*F24F 11/56* (2018.01)
(Continued)

(52) U.S. Cl.
CPC ..... *F24F 11/65* (2018.01); *F24F 11/56* (2018.01); *F24F 11/80* (2018.01); *F24F 2110/10* (2018.01)

(58) Field of Classification Search
CPC .. F24F 11/65; F24F 11/56; F24F 11/80; F24F 2110/10; F24F 11/46; F24F 11/64; F24F 11/30
See application file for complete search history.

(56) References Cited

U.S. PATENT DOCUMENTS 9,447,985 B2 9/2016 Johnson
10,871,756 B2 12/2020 Johnson et al.
(Continued)

FOREIGN PATENT DOCUMENTS

CA 2957726 A1 3/2016
CA 3043996 A1 2/2018
(Continued)

OTHER PUBLICATIONS

CoolingLogic, "CoolingLogic: Up early, saving billions." URL: http://coolinglogic.com/documents/MarketingFlyer_FINAL_HiRes8.5x11.pdf, retrieved from internet Oct. 27, 2022 (1 page).
(Continued)

*Primary Examiner* — Alicia M. Choi
(74) *Attorney, Agent, or Firm* — Fletcher Yoder, P.C.

(57) ABSTRACT

A heating, ventilation, and/or air conditioning (HVAC) system includes a conditioning system configured to condition a return air flow directed through the HVAC system and a control system configured to determine a difference value between an operating parameter value of the return air flow and a sensed operating parameter value of a space serviced by the HVAC system, retrieve a stored target operating parameter value of the space, and operate the HVAC system based on the difference value, the stored target operating parameter value, or both.

20 Claims, 6 Drawing Sheets

(51) Int. Cl.
*F24F 11/80* (2018.01)
*F24F 110/10* (2018.01)

(56) References Cited

U.S. PATENT DOCUMENTS

| | | | | |
|---|---|---|---|---|
| 10,908,578 | B2 | 2/2021 | Johnson et al. | |
| 10,921,768 | B2 | 2/2021 | Johnson et al. | |
| 11,156,978 | B2 | 10/2021 | Johnson et al. | |
| 2011/0209490 | A1 | 9/2011 | Mijanovic et al. | |
| 2017/0211824 | A1 | 7/2017 | Perez et al. | |
| 2017/0211834 | A1 | 7/2017 | Perez et al. | |
| 2019/0137156 | A1 | 5/2019 | Popli | |
| 2019/0250654 | A1 | 8/2019 | Seiler et al. | |
| 2020/0018505 | A1* | 1/2020 | Wan | F24F 11/38 |
| 2020/0292193 | A1 | 9/2020 | Jayarathne et al. | |
| 2021/0396414 | A1 | 12/2021 | Delgoshaei et al. | |
| 2022/0196279 | A1 | 6/2022 | Son et al. | |
| 2024/0085048 | A1* | 3/2024 | Yang | F24F 11/84 |

FOREIGN PATENT DOCUMENTS

| | | | |
|---|---|---|---|
| CN | 107401820 | A | 11/2017 |
| CN | 113339970 | A | 9/2021 |
| EP | 3 186 687 | A4 | 7/2017 |
| EP | 3 497 377 | A1 | 6/2019 |
| KR | 100630831 | B1 | 10/2006 |
| WO | 2015045579 | A1 | 4/2015 |

OTHER PUBLICATIONS

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).
Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).
Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).
Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).
Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).
Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).
Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).
Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).
Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).
Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).
Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).
Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).
Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).
Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).
Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).
Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).
Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).
Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).
Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).
Johnson Solid State LLC, "Cooling Logic Overview," URL: http://coolinglogic.com/documents/CoolingLogic_Overview_High_Quality.mp4, retrieved from internet Oct. 27, 2022 (16 pages).
Johnson Solid State LLC, "So what is CoolingLogic™?" URL: http://coolinglogic.com/Coolinglogic-How-it-Works.html, retrieved from the internet Oct. 27, 2022 (3 pages).
Johnson, David, "A Method to Increase HVAC System Efficiency and Decrease Energy Consumption," White Paper: Johnson Solid State, LLC, URL: http://coolinglogic.com/documents/16102106_White_Paper_High_Resolution_Protected.pdf, Sep. 24, 2016 (51 pages).
Johnson, David, "CoolingLogic™: Mosaic Christian Church a Case Study," Report: Johnson Solid State, LLC, URL: http://coolinglogic.com/documents/19020301_Mosaic_Christian_Coolinglogic_Case_Study.pdf, Feb. 2, 2019 (140 pages).
Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).
Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).

(56) References Cited

OTHER PUBLICATIONS

Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

SYSTEMS AND METHODS FOR OPERATING AN HVAC SYSTEM

CROSS REFERENCE TO RELATED APPLICATION

This application is a continuation of U.S. patent application Ser. No. 17/541,083, entitled "SYSTEMS AND METHODS FOR OPERATING AN HVAC SYSTEM," filed Dec. 2, 2021, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In some embodiments, the HVAC system may operate based on an operating parameter of a space to condition the space toward a target or set operating parameter. Unfortunately, in some circumstances, the HVAC system may not receive sensor data indicative of the operating parameter of the space and therefore may not operate effectively or efficiently to condition the space.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a conditioning system configured to condition a return air flow directed through the HVAC system and a control system configured to determine a difference value between an operating parameter value of the return air flow and a sensed operating parameter value of a space serviced by the HVAC system, retrieve a stored target operating parameter value of the space, and operate the HVAC system based on the difference value, the stored target operating parameter value, or both.

In one embodiment, a non-transitory computer-readable medium includes instructions stored thereon. The instructions, when executed by processing circuitry, are configured to cause the processing circuitry to receive first data indicative of a temperature of a return air flow received by a heating, ventilation, and/or air conditioning (HVAC) system from a first sensor, receive second data indicative of a sensed temperature of a space serviced by the HVAC system from a second sensor, determine a difference value between the temperature of the return air flow and the sensed temperature of the space, determine an alternative temperature value of the space based on the difference value in response to a determination that the second data indicative of the sensed temperature of the space is not received from the second sensor, and operate the HVAC system based on the alternative temperature value of the space in response to the determination that the second data indicative of the sensed temperature of the space is not received from the second sensor.

In one embodiment, a control system for a heating, ventilation, and/or air conditioning (HVAC) system. The control system includes processing circuitry and a memory that includes instructions stored thereon. The instructions, when executed by the processing circuitry, are configured to cause the processing circuitry to operate the HVAC system in a primary operating mode based on first data received from a first sensor and indicative of a temperature of a return air flow received by the HVAC system, second data received from a second sensor indicative of a sensed temperature of a space serviced by the HVAC system, and third data received from a control device and indicative of a target temperature of the space, determine a difference value between the first data and the second data and store the difference value in the memory in the primary operating mode, store the third data received from the control device in the memory as a previous target temperature of the space in the primary operating mode, and operate the HVAC system in an alternative operating mode based on the difference value in response to a determination that the second data is not received from the second sensor, based on the previous target temperature in response to a determination that the third data is not received from the control device, or both.

BRIEF DESCRIPTION OF THE DRAWINGS

Various aspects of this disclosure may be better understood upon reading the following detailed description and upon reference to the drawings in which.

DETAILED DESCRIPTION

Figure 1:
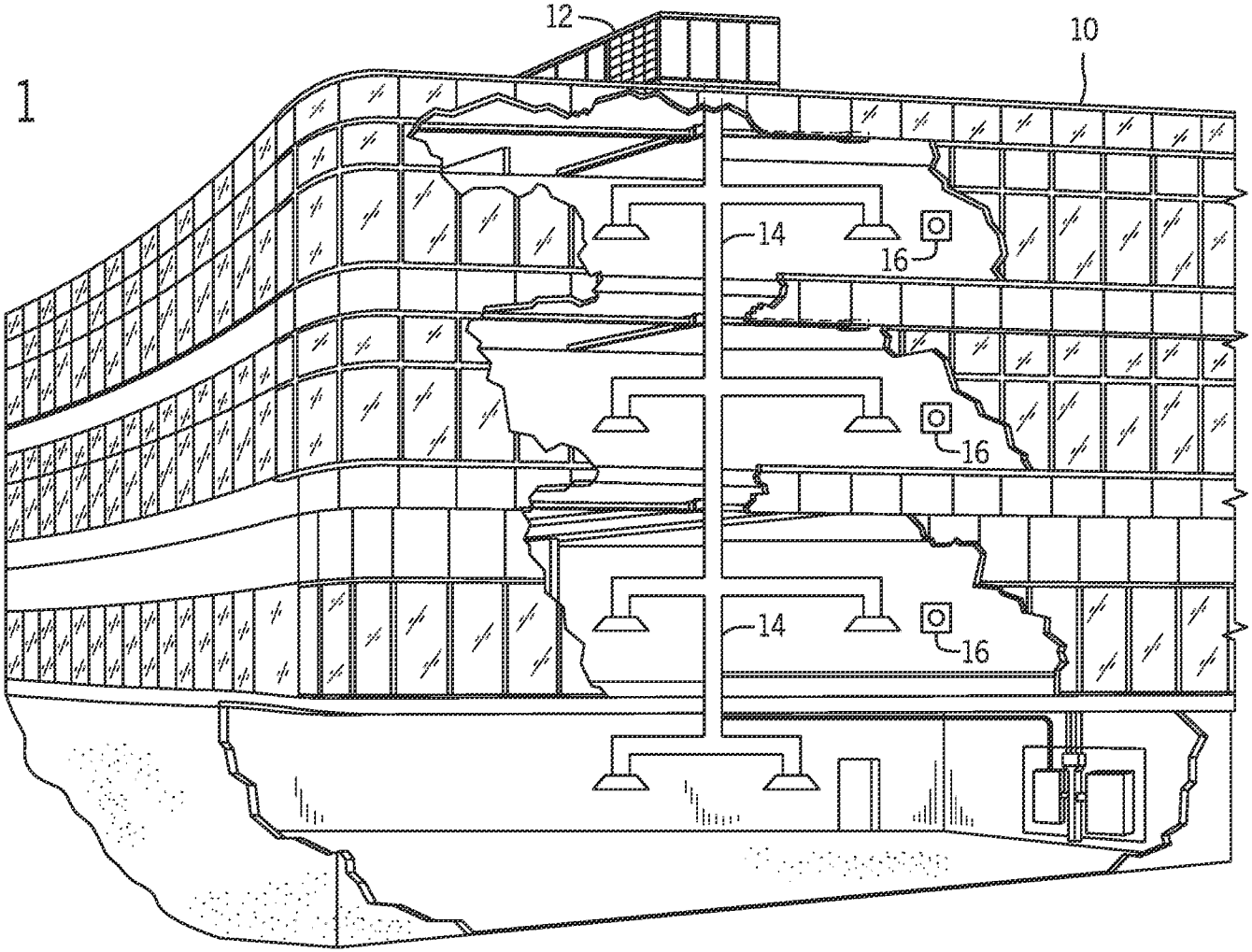
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may be configured to operate to condition a space. For example, the HVAC system may be configured to heat and/or cool the space to a target or set point temperature value or other operating parameter value by conditioning and controlling supply of an air flow to the space. A control system of the HVAC system may be configured to operate the HVAC system based on data received from one or more sensors. For example, the control system may be configured to receive data indicative of a sensed, actual, or current temperature of the space, to operate the HVAC system to condition a supply air flow based on the sensed temperature, and to operate the HVAC system to deliver the conditioned supply air flow to the space to adjust the temperature of the space toward the target temperature value.

In some embodiments, the control system may be configured to receive the data indicative of the sensed temperature (e.g., a sensed temperature value, a current temperature value) from one or more sensors positioned within the space and the data indicative of the target temperature (e.g., a target temperature value, set point temperature value) from a control device (e.g., a thermostat). Unfortunately, in some circumstances, such data may not be successfully received by the control system or may otherwise be unavailable or inaccessible to the control system. For example, a communications link (e.g., Wi-Fi connection, wireless connection) communicatively coupling the sensor(s) and/or the control device to the control system may be unavailable, such as due to occasional (e.g., unexpected) interruptions in wireless communications links between the sensor(s) and the control system and/or between the control device and the control system. In additional or alternative circumstances, the sensor(s) and/or the control device may be faulty and/or the sensor(s) and/or the control device may be communicatively decoupled (e.g., temporarily decoupled) from the control system for maintenance, replacement, or other purposes. In such circumstances, traditional HVAC control systems may not be configured to operate the HVAC system to condition the supply air flow and the space. For example, in certain conventional HVAC systems, the control system may suspend operation of the HVAC system when data from the sensor(s) positioned within the space and/or the control device is unavailable or the sensor(s) or control device are otherwise not communicating data to the control system. As such, the space may not be conditioned when data from the sensor(s) and/or the control device is unavailable.

Thus, it is presently recognized that there is a need to enable continued operation of the HVAC system to provide conditioning for the space when data from the sensor(s) and/or the control device is unavailable or otherwise not received by the control system. Accordingly, embodiments of the present disclosure are directed to systems and methods for using alternative (e.g., historical, recorded, and/or substitute) data to enable continued operation of the HVAC system when the data from the sensor(s) and/or the control device is not received. As an example, in response to a determination that data indicative of a sensed temperature of the space is not received from the sensor(s) that typically provide such data, an alternative or substitute value for the temperature of the space may be determined and utilized to enable continued operation of the HVAC system. The determination that the data indicative of the sensed temperature of the space is not received from the sensor(s) may be based on a detected interruption in a communications link between the sensor(s) and the control system.

The alternative or substitute value may be based on previously-collected data indicative of the temperature of the space, which may be recorded or stored during a prior time period when a communications link between the sensor(s) and the control system was established. The alternative or substitute value may also be based on a detected temperature (e.g., a temperature value) of an air flow received by the HVAC system (e.g., a return air flow), which may include air flow directed from the space to the HVAC system. The detected air flow temperature and the previously-collected (e.g., stored) space temperature may be compared with one another to determine or calculate a temperature difference value (e.g., a delta, an offset value) therebetween. In response to a determination that the data indicative of the sensed temperature of the space is not received or is unavailable, the alternative or substitute value for the sensed temperature of the space may be determined by applying the calculated temperature difference value to the detected temperature of the air flow received by the HVAC system. The control system may then operate the HVAC system in an alternative operating mode based on the alternative value for temperature of the space as a substitute for the unavailable sensed temperature of the space that would typically be received from the sensor(s) disposed within the space.

As another example, in response to a determination that data indicative of a target temperature (e.g., set point temperature) of the space is not received or is unavailable from the control device, such as due to an interruption in communication between the control device and the control system, an alternative or substitute target temperature of the space may be determined. For example, the alternative or substitute target temperature may be based on a stored target temperature value of the space, which may be recorded or stored during a prior time period when a communications link between the control device and the control system was established. In response to a determination that the data indicative of the target temperature of the space is not received or is unavailable from the control device, the previous or stored target temperature of the space may be retrieved, and the alternative or substitute target temperature of the space may be determined based on the previous target temperature. The control system may then operate the HVAC system in the alternative operating mode based on the alternative target temperature of the space as a substitute for the unavailable data indicative of the target temperature of the space that would typically be received from the control device.

Therefore, in the alternative operating mode, the control system may continue to operate the HVAC system to operate to provide conditioned air to the space based on the alternative temperature of the space and/or the alternative target temperature of the space. As such, the HVAC system may continue to provide conditioning to the space while data from the sensor(s) and/or the control device is not received (e.g., during a communications link interruption). In this manner, the presently disclosed techniques enable more reliable operation of HVAC systems that include components configured to provide wireless data (e.g., feedback) to the control system of the HVAC system. Although the present disclosure primarily discusses operation of the HVAC system based on temperature data, the HVAC system may be operated based on any other suitable parameter, data, or feedback. For example, the HVAC system may be operated based on humidity data, such as based on a difference value between a previous (e.g., stored) sensed humidity measurement (e.g., a sensed humidity value) of the space and a humidity measurement (e.g., a humidity value) of the air flow received by the HVAC system from the space and/or based on a previous (e.g., stored) target humidity set point (e.g., a previous target humidity value) to enable continued operation of the HVAC system during periods when data from the sensor(s) and/or the control device is not received or is unavailable.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
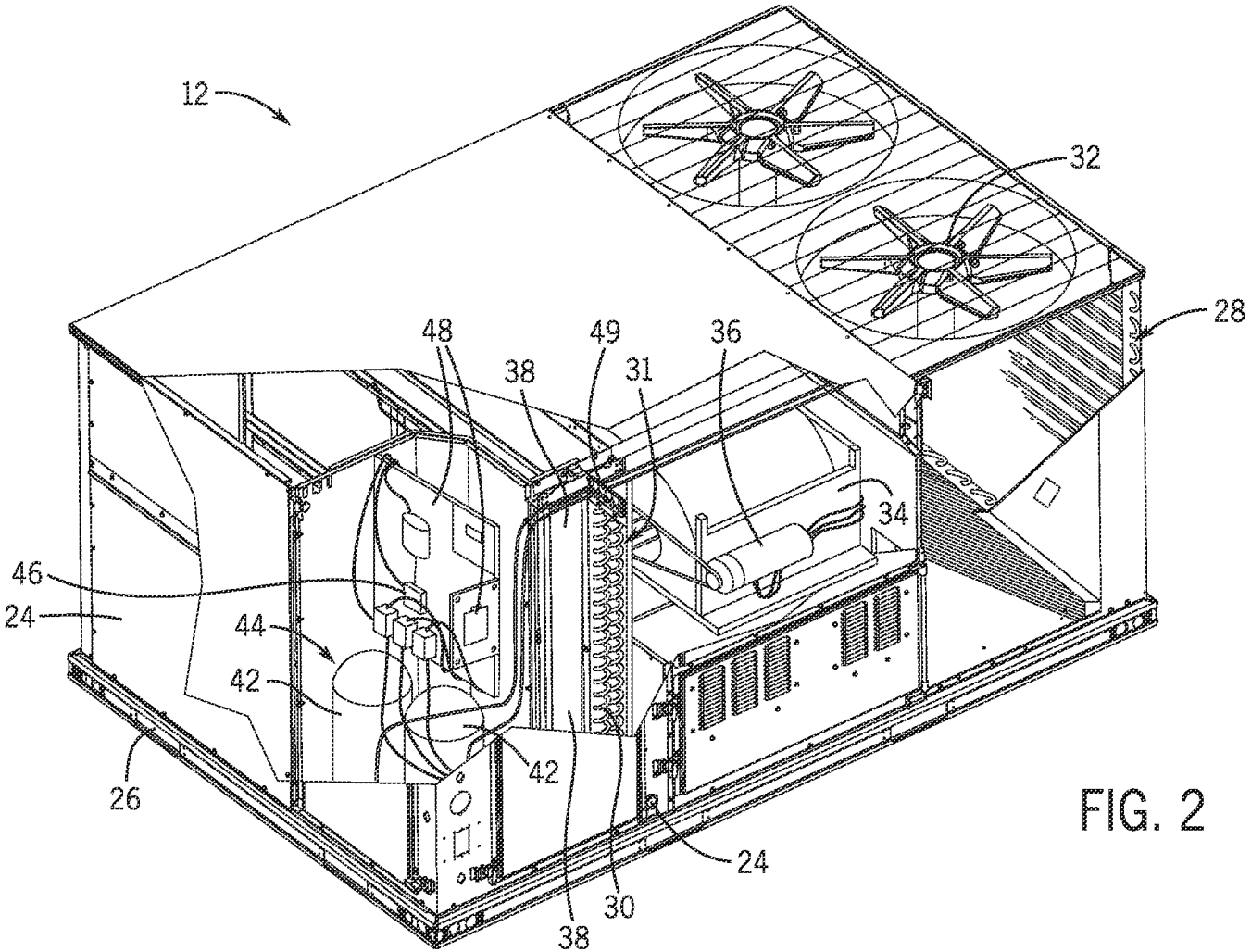
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
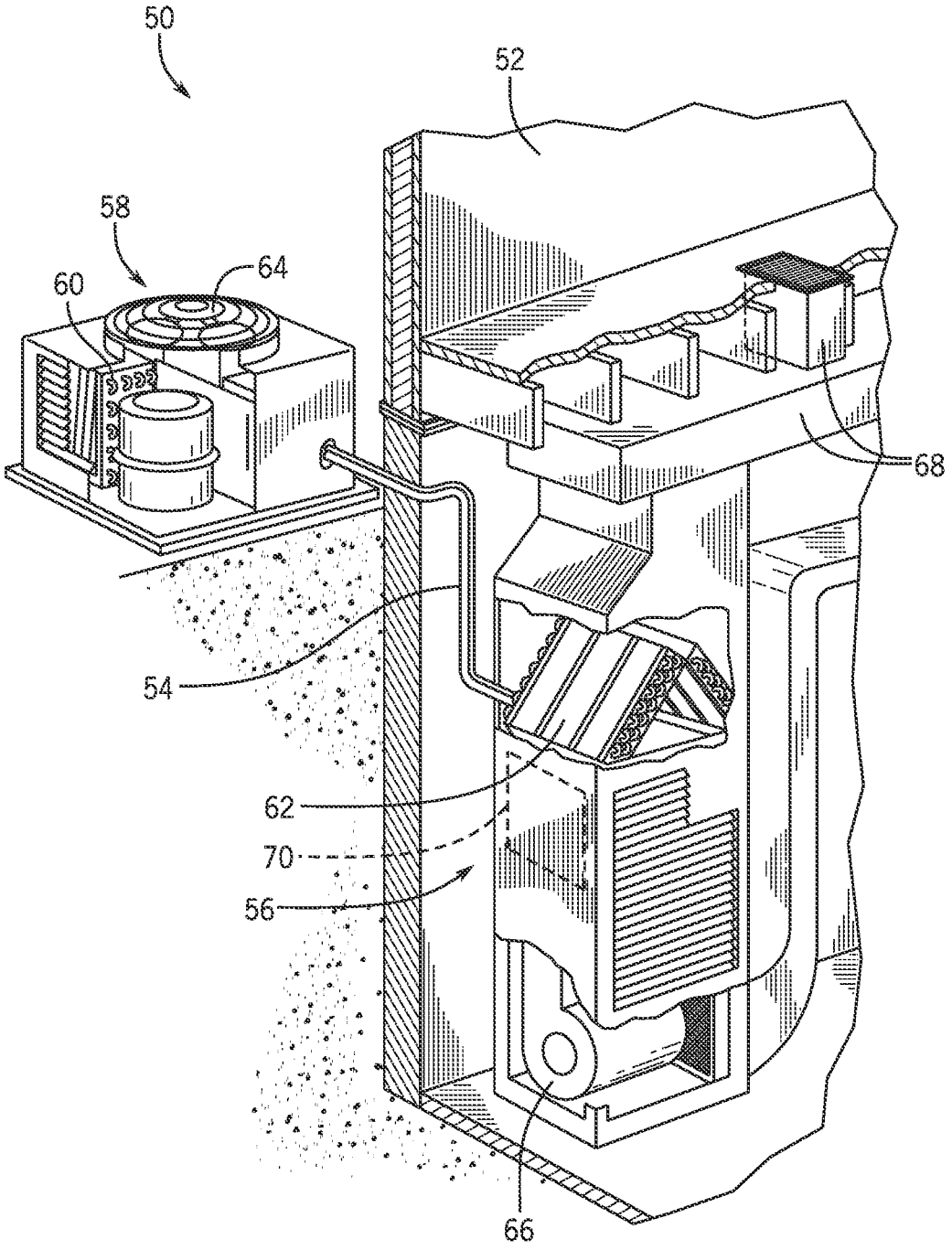
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
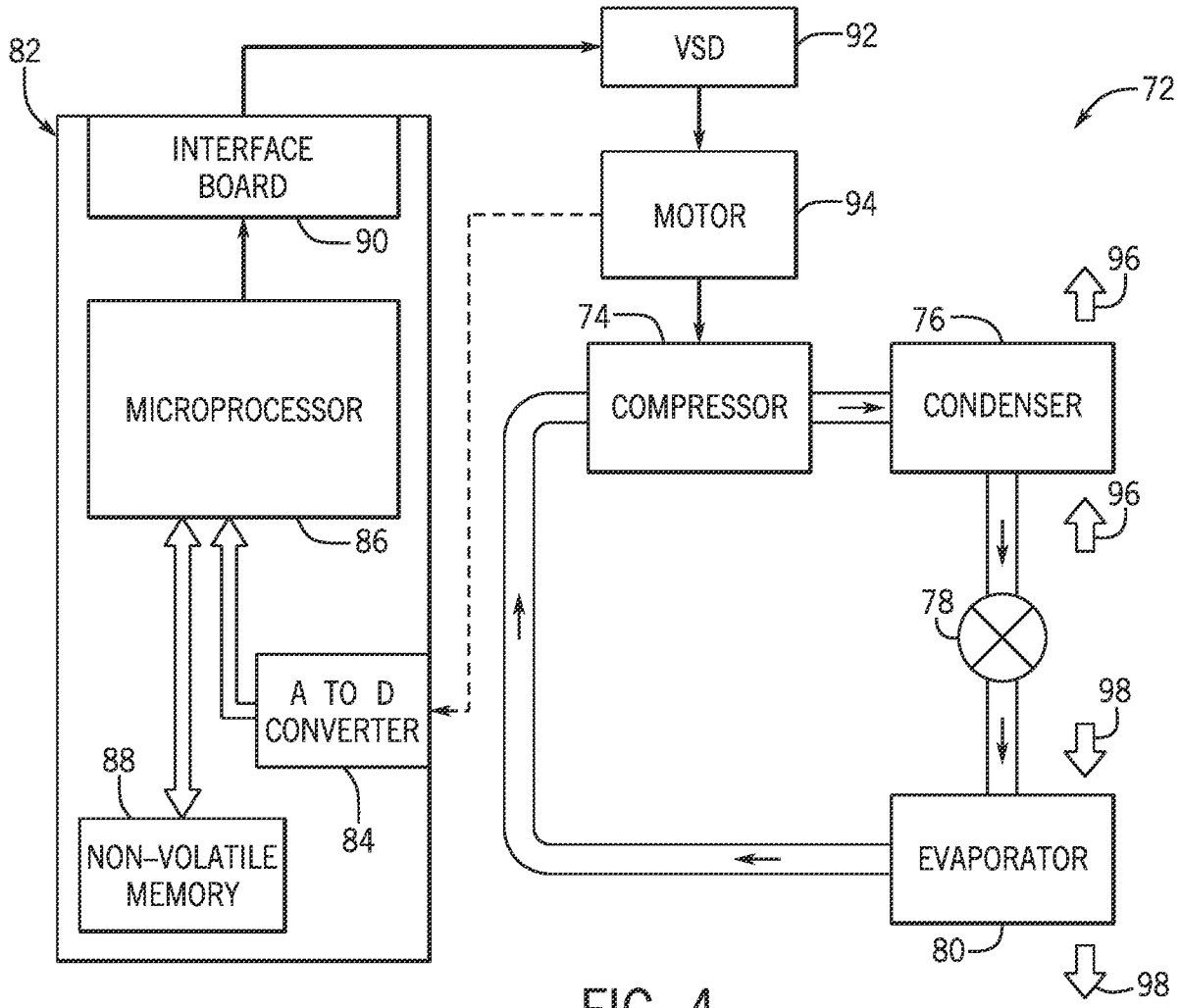
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, the present disclosure is directed to an HVAC system that includes a control system configured to operate the HVAC system while certain data typically provided to the control system is not received. In certain embodiments, in a primary or standard operating mode, the control system may operate the HVAC system based on data or feedback received from one or more components communicatively coupled to the control system. For example, the HVAC system may include one or more sensors (e.g., wireless sensors), which may be disposed within a space conditioned by the HVAC system, and a control device, such as a thermostat (e.g., wireless thermostat) disposed within the space. The sensors disposed within the space may be configured to sense (e.g., determine, measure, detect) a temperature within the space and transmit (e.g., wirelessly transmit) data indicative of the sensed temperature (e.g., a sensed temperature value, a current temperature value) within the space. The control device may be configured to transmit (e.g., wirelessly transmit) data indicative of a target temperature (e.g., a target temperature value, set point temperature value) of the space. For example, the control device may be a thermostat configured to receive an input from a user indicative of the target temperature. The HVAC system may also include other components communicatively coupled to the control system, such as a sensor (e.g., wired sensor) configured to transmit (e.g., via a hardwired connection) data indicative of a temperature (e.g., a temperature value) of an air flow (e.g., a return air flow) directed from the space to the HVAC system.

In the primary operating mode, the control system may utilize data received from the sensors disposed within the space (e.g., a sensed temperature of the space) and from the control device (e.g., a target temperature) to control operation of the HVAC system to adjust the sensed temperature within the space toward the target temperature by operating the HVAC system to condition and direct a supply air flow toward the space. Unfortunately, in some instances, a communications link (e.g., wireless communications link) between the sensors within the space and the control system and/or between the control device and the control system may be interrupted, and the control system may not receive the data typically received from the sensors and/or the control device. Accordingly, present embodiments are directed to an alternative operating mode of the HVAC system and/or control system in which the control system is configured to determine and utilize alternative values as substitutes for the data typically received from the sensors and/or the control device. In this way, the control system enables continued operation of the HVAC system to provide conditioning to a space during periods when communications with the sensors and/or the control device may be interrupted.

For example, in response to a determination that data indicative of a sensed temperature of the space is not received from a sensor (e.g., wireless sensor) disposed within the space, the control system may determine an alternative temperature (e.g., an alternative temperature value, a substitute temperature) of the space to be utilized by the control system to enable continued operation of the HVAC system. The alternative temperature of the space may be determined or calculated by applying a temperature difference value to a detected temperature of a return air flow received by the HVAC system from the space. The temperature difference value may be a previously calculated value that is stored or recorded by the control system (e.g., during prior operation in the primary operating mode). For example, the temperature difference value may be a difference between a previously detected temperature of the return air flow and a previously detected temperature within the space determined during operation of the HVAC system in the primary operating mode (e.g., during a time period when data indicative of the sensed temperature of the space was received from a sensor disposed within the space). The control system may then operate the HVAC system based on the alternative temperature of the space as a substitute for the unavailable data indicative of the sensed temperature of the space.

Similarly, in response to a determination that data indicative of a target temperature of the space is not received from a control device (e.g., thermostat) disposed within the space, the control system may determine an alternative target temperature (e.g., an alternative target temperature value, substitute target temperature) of the space based on a prior target temperature of the space previously communicated to the control system by the control device (e.g., during prior operation in the primary operating mode). The control system may then operate the HVAC system based on the alternative target temperature of the space instead of the unavailable data indicative of the target temperature of the space. Thus, the HVAC system may continue to operate to condition the space while data indicative of the sensed temperature of the space and/or the target temperature of the space is not received (e.g., due to wireless communication interruptions).

Figure 5:
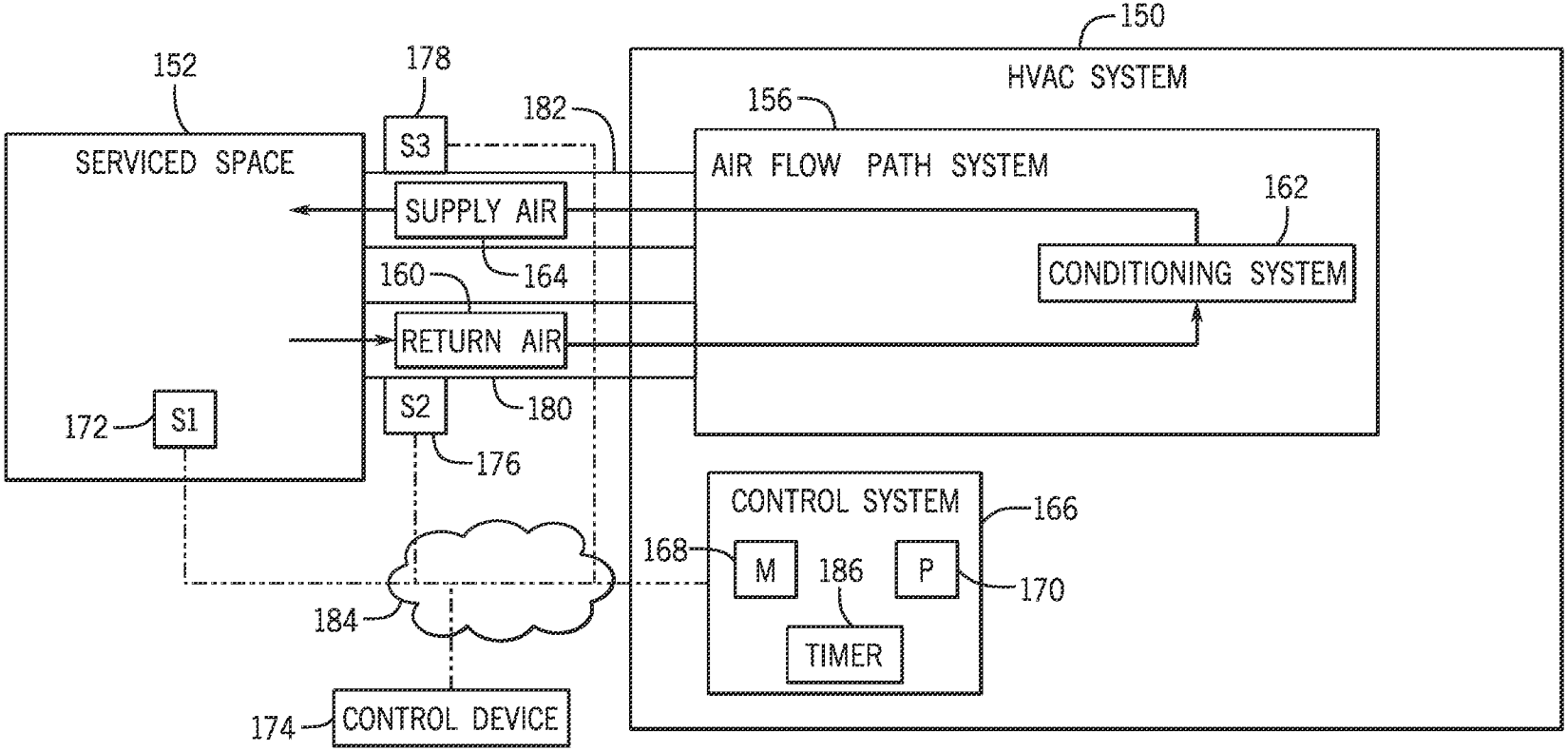
FIG. 5 is a schematic diagram of an embodiment of an HVAC system configured to operate to condition a space, in accordance with an aspect of the present disclosure.

With this in mind, FIG. 5 is a schematic diagram of an embodiment of an HVAC system 150 configured to service a space 152, such as a room of a building or other structure. The HVAC system 150 may be the HVAC unit 12, the heating and cooling system 50, or any other suitable HVAC system configured to provide conditioning to a conditioned space. The HVAC system 150 may receive air from the space 152, such as via an air flow path system 156, which may include ductwork (e.g., the ductwork 14, the ductwork 68), a fan (e.g., the fan 34, the blower 66), a damper, and so forth, configured to circulate air flow through the HVAC system 150 and between the HVAC system 150 and the space 152. The air entering the air flow path system 156 from the serviced space 152 may include a return air flow 160. The HVAC system 150 may direct the return air flow 160 to a conditioning system 162 of the HVAC system 150, which may include the vapor compression system 72 (e.g., a refrigerant circuit), the furnace system 70, and/or other HVAC equipment configured to condition an air flow. The conditioning system 162 (e.g., HVAC equipment) may be configured to condition the return air flow 160, such as to heat, cool, and/or dehumidify the return air flow 160, thereby creating a supply air flow 164. The HVAC system 150 and the air flow path system 156 may then deliver the supply air flow 164 to the space 152 to condition the space 152. In certain embodiments, the HVAC system 150 may also receive an ambient air flow, such as an outdoor air flow, from an ambient environment external to the HVAC system 150 and the space 152. For example, the ambient air flow may mix with the return air flow 160. Thus, the conditioning system 162 may be configured to condition the ambient air flow mixed with the return air flow 160.

The HVAC system 150 may include or be communicatively coupled to a control system 166 (e.g., a controller, an automation controller) configured to operate the HVAC system 150. The control system 166 may be a component of an HVAC unit, an indoor HVAC unit, an air handler, a furnace, an outdoor HVAC unit, or a component of another portion of the HVAC system 150. The control system 166 may include a memory 168 and processing circuitry 170. The memory 168 may include a non-transitory computer-readable medium that may include volatile memory, such as random-access memory (RAM), and/or non-volatile memory, such as read-only memory (ROM), flash memory, optical drives, hard disc drives, solid-state drives, or any other suitable non-transitory computer-readable medium storing instructions that, when executed by the processing circuitry 170, may control operation of the HVAC system 150 (e.g., the conditioning system 162). To this end, the processing circuitry 170 may include one or more application specific integrated circuits (ASICs), one or more field programmable gate arrays (FPGAs), one or more programmable logic devices (PLD), one or more programmable logic arrays (PLA), one or more general purpose processors, or any combination thereof configured to execute such instructions.

By way of example, the control system 166 may operate components of the HVAC system 150 to adjust an operating parameter value of the space 152 toward a target operating parameter value. For instance, the operating parameter may include a temperature. To this end, one or more first sensors 172 (e.g., a room sensor, a room temperature sensor) may be disposed within the space 152 and may be configured to determine a sensed, actual, or current temperature (e.g., a sensed temperature value, a current temperature value, an actual temperature value) of the space 152. In certain embodiments, the first sensors 172 may be wireless sensors communicatively coupled to the control system 166 via a wireless communications link. In some embodiments, multiple first sensors 172 may be positioned at different locations in the space 152, and each first sensor 172 may determine a different temperature in the space 152. For example, the serviced space 152 may include multiple rooms, zones, or other areas, and each room, zone, or area may include one of the first sensors 172 disposed therein. The control system 166 may receive data from each of the first sensors 172, and each data may be indicative of a respective temperature corresponding to a portion of the serviced space 152 associated with each first sensor 172. Based on the data, the control system 166 may determine an average (e.g., a mathematical mean, median, mode) and/or weighted summation of the temperatures, and designate the determined average temperature as the sensed temperature of the space 152. However, in other embodiments, the control system 166 may determine the sensed temperature of the space 152 based on data from a single first sensor 172.

The HVAC system 150 may also include or be communicatively coupled to a control device 174, which may include any suitable device configured to communicate data indicative of a target temperature (e.g., a target temperature value, a set point temperature) of the space 152, such as a thermostat, a mobile device, a cloud-computing system, and so forth. As an example, the control device 174 may determine the target temperature of the space 152 based on a user input, such as a user interaction with an interface (e.g., a touchscreen, a button, a dial, a slider) of the control device 174. As another example, the control device 174 may automatically determine the target temperature of the space 152 based on a setting, such as schedule (e.g., a schedule set by a user input) that may associate a respective target temperature with a time of day, time of year, and so forth. The control system 166 may operate the HVAC system 150 to adjust the temperature of the space 152 indicated by the first sensor(s) 172 toward the target temperature indicated by the control device 174. That is, the control system 166 may control operation of the HVAC system 150 (e.g., the conditioning system 162) to generate the supply air flow 164 and provide the supply air flow 164 to the space 152 to cause the sensed temperature to approach the target temperature.

More specifically, the control system 166 may operate the HVAC system 150 to condition the return air flow 160 (e.g., a mixture of the return air flow 160 and ambient air flow) and produce the supply air flow 164 based on the target temperature of the space 152. That is, the control system 166 may operate the HVAC system 150 (e.g., the conditioning system 162) to adjust (e.g., increase, decrease) a temperature of the return air flow 160 to generate the supply air flow 164 and direct the supply air flow 164 to the space 152 in order to adjust the temperature of the space 152 toward the target temperature of the space 152. To this end, the control system 166 may be configured to receive data from additional sensors configured to detect respective temperatures (e.g., temperature values) of air flows received by, directed through, and/or discharged by the HVAC system 150.

For example, the HVAC system 150 may include a second sensor 176 (e.g., a return air temperature sensor) configured to detect a temperature of the return air flow 160 and a third sensor 178 (e.g., a supply air temperature sensor) configured to detect a temperature of the supply air flow 164. The second sensor 176 may, for instance, be positioned within a return air duct 180 of the air flow path system 156, and the third sensor 178 may, for instance, be positioned within a supply air duct 182 of the air flow path system 156. The return air duct 180 may be a portion of ductwork configured to direct the return air flow 160 from the space 152 to the HVAC system 150, a section or inlet of a housing of the HVAC system 150 (e.g., an inlet duct of an air handler), or any other suitable portion of the air flow path system 156 through which the return air flow 160 is directed from the space 152 to the HVAC system 150. Similarly, the supply air duct 182 may be a section of the HVAC system 150 downstream of the conditioning system 162, such as a plenum or duct downstream of a heat exchanger (e.g., evaporator, furnace) of the conditioning system 162 that discharges the supply air flow 164 toward the space 152. In additional or alternative embodiments, the second sensor 176 may be positioned within the housing of the HVAC system 150 adjacent to the return air duct 180 where the return air flow 160 may be received at the housing, and the third sensor 178 may be positioned within the housing of the HVAC system 150 adjacent to the supply air duct 182 where the supply air flow 164 may be discharged from the housing. The control system 166 may operate the HVAC system 150 (e.g., the conditioning system 162) based on the data received from the second sensor 176 and/or the third sensor 178 in order to adjust the temperature of the return air flow 160 to produce the supply air flow 164 having a desirable or target temperature for conditioning the space 152 (e.g., to achieve the target temperature of the space 152).

The control system 166 is configured, in a primary operating mode (e.g., normal operating mode), to operate the HVAC system 150 based on data received from the first sensor(s) 172, the second sensor 176, and/or the third sensor 178 to condition the return air flow 160 to produce the supply air flow 164 and deliver the supply air flow 164 to the space 152 in order to cause the temperature in the space 152 to approach a target temperature. However, in some circumstances, the data from the first sensor(s) 172 and/or the data from the control device 174 may not be received or may otherwise be unavailable. As an example, the first sensor(s) 172 and/or the control device 174 may not be communicatively coupled to the control system 166. In some instances, the first sensor(s) 172 and/or the control device 174 may initially be communicatively coupled to the control system 166 via a network 184 (e.g., a wireless network), and a communications link (e.g., wireless connection) between the first sensor(s) 172 and the control system 166 and/or between the control device 174 and the control system 166 established via the network 184 may be interrupted or otherwise unavailable. For example, the network 184 may become unable to establish the communications link (e.g., wireless connection). Additionally or alternatively, the first sensor(s) 172 and/or the control device 174 may be communicatively decoupled from the control system 166 for maintenance and/or other service activity. As another example, the first sensor(s) 172 and/or the control device 174 may not operate properly and/or may be unable to provide data to the control system 166 (e.g., due to faulty operation, inadequate hardwired connection, loss of power). In such circumstances, the control system 166 may not receive data from the first sensor(s) 172 and/or from the control device 174. As a result, the control system 166 may not operate the HVAC system 150 in the primary operating mode using data that is typically received from the first sensor(s) 172 and/or the control device 174.

Accordingly, the control system 166 is also configured to operate the HVAC system 150 in an alternative operating mode in which the HVAC system 150 may continue to operate to provide the supply air flow 164 to condition the space 152 during time periods when data from the first sensor(s) 172 and/or the control device 174 is not received by the control system 166. For example, based on a determination that data from the first sensor(s) 172 is not received (e.g., based on a determination that a communications link between the first sensor(s) 172 and the control system 166 is interrupted), the control system 166 may operate in the alternative operating mode to determine an alternative temperature to use as a substitute for the sensed temperature of the space 152 that would otherwise be provided by the first sensor(s) 172.

In an example embodiment having multiple first sensors 172 disposed within the space 152, data from a subset of the first sensors 172 may not be received, but data from another subset of the first sensors 172 (e.g., a threshold quantity of first sensors 172, at least one first sensor 172, at least three first sensors 172, at least five first sensors 172) may be received. In such an embodiment, the control system 166 may determine the unavailability of data from the subset of the first sensors 172 and the availability of the other first sensors 172 and in response, the control system 166 may determine the alternative temperature of the space 152 based on the available data from the other subset of the first sensors 172 (e.g., based on a mathematical mean, median, or mode of the available data received from the first sensors 172). For example, the space 152 may include four zones with one of the first sensors 172 associated with each zone. Based on a determination that data from the first sensor 172 associated with a particular zone of the four zones is not received by the control system 166, the control system 166 may operate the HVAC system 150 in the alternative operating mode to condition and provide the supply air flow 164 to the particular zone based on data received from the first sensors 172 associated with the other three zones. In other words, the alternative temperature of the space 152 may be based on the data received from the first sensors 172 associated with the other three zones.

In another example embodiment, the control system 166 may determine that data from all first sensors 172 in the space 152 is not received. In response to the determination, the control system 166 may determine an alternative temperature value of the space 152 (e.g., a substitute temperature value) based on data received from the second sensor 176. More specifically, the alternative temperature value may be based at least in part on data received from the second sensor 176. In other words, the alternative temperature value may be based on data indicative of the temperature of the return air flow 160 directed from the space 152 to the HVAC system 150. In some embodiments, the return air flow 160 may be air generally received from the space 152 or air received from a portion of the space 152 (e.g., air received from a particular room or zone of the space 152). The data indicative of the temperature of the return air flow 160 may be modified or manipulated, in accordance with the present techniques, to determine the alternative temperature value of the space 152 utilized in the alternative operating mode.

To enable operation in the alternative operating mode, the temperature of the return air flow 160 received by the control system 166 may be adjusted or modified based on data stored or recorded by the control system 166. As mentioned above, the control system 166 may be configured to determine a temperature difference value (e.g., offset value, offset factor, modifier, adjustment factor) between a sensed temperature of the space 152 indicated by the first sensor(s) 172 and a sensed temperature of the return air flow 160 indicated by the second sensor 176 For example, during operation in the primary operating mode (e.g., when data from the first sensor(s) 172 is received by the control system 166), the control system 166 may calculate the temperature difference value between the sensed temperature of the space 152 indicated by the first sensor(s) 172 and the temperature of the return air flow 160 indicated by the second sensor 176 The sensed temperature of the space 152 utilized in the temperature difference value calculation may be based on data received from one first sensor 172, averaged data from multiple first sensors 172, or other data indicative of the temperature of the space 152 (e.g., received from one or more first sensors 172) The calculated temperature difference value may then be stored by the control system 166 (e.g., in the memory 168). For example, the control system 166 may calculate and store the temperature difference value at a predetermined frequency (e.g., every second, every 5 seconds, every 30 seconds) during operation of the HVAC system 150 in the primary operating mode. The control system 166 may be configured to store or record one instance or value of the temperature difference value or may store multiple instances of the temperature difference value. In other words, the control system 166 is configured to track the temperature difference between the temperature of the return air flow 160 and the temperature within the space 152 during operation of the HVAC system 150 in the primary operating mode.

In response to a determination that the data from the first sensor(s) 172 is not received, the control system 166 may determine the alternative temperature value of the space 152 based on the temperature of the return air flow 160 and the stored temperature difference value calculated during operation in the primary operating mode. Specifically, the control system 166 may determine the temperature of the return air flow 160 (e.g., via data received from the second sensor 176), retrieve the stored temperature difference value (e.g., from the memory 168), and apply the stored temperature difference value to the temperature of the return air flow 160 to generate the alternative temperature value of the space 152. The temperature difference value retrieved by the control system 166 may be a most recently calculated temperature difference value, an average of multiple temperature difference values previously calculated, a weighted summation of recent temperature difference values, a linear regression of recent temperature difference values, or other suitable value based on a temperature difference between the temperature of the return air flow 160 and the temperature within the space 152. Thus, the temperature difference value may include or be based on data previously received from the first sensor(s) 172. Indeed, the control system 166 may be configured to update the stored temperature difference value when the data from the first sensor(s) 172 is received.

The temperature difference value may include a numerical value to be added to or subtracted the temperature of the return air flow 160 determined by the second sensor 176 when the data from the first sensor(s) 172 is not received. For example, the temperature difference value stored in the control system 166 may be −1 degree Celsius, and in response to receiving data from the second sensor 176 indicating that the temperature of the return air flow 160 is 25 degrees Celsius (e.g., when data from the first sensor(s) 172 is not received), the control system 166 may determine that the alternative temperature of the space 152 is 24 degrees Celsius. Additionally or alternatively, the control system 166 may utilize an equation, a multiplier, or other factor that accommodates a difference, gain, discrepancy, or variance between the temperature of the return air flow 160 and the temperature of the space 152 detected during the primary operating mode to generate the alternative temperature value of the space 152.

In the alternative operating mode, the control system 166 may utilize the alternative temperature value of the space 152 to enable continued operation of the HVAC system 150 to provide conditioning to the space 152. For example, the alternative temperature value of the space 152 may be compared to a target temperature for the space 152 received from the control device 174 when the control device 174 is communicatively coupled to the control system 166, and the control system 166 may control operation of the HVAC system 150 based on the comparison to condition and provide the supply air flow 164 to the space 152. Indeed, the control system 166 may operate the HVAC system 150 (e.g., the conditioning system 162) to generate the supply air flow 164 and provide the supply air flow 164 to the space 152 to cause the alternative temperature value to approach the target temperature.

However, in some instances, the control device 174 may not be communicatively coupled to the control system 166, and the control system 166 may not receive data indicative of the target temperature of the space 152. In other words, the control system 166 may not receive data from the control device 174 (e.g., due to an interruption in a wireless network configured to establish communications links therebetween). In such instances, the control system 166 may be configured to reference stored data to enable continued operation of the HVAC system 150 in the alternative operating mode.

While data from the control device 174 is received (e.g. during the primary operating mode), the control system 166 may monitor and store (e.g., in the memory 168) target temperature values of the space 152 communicated to the control system 166 by the control device 174. As an example, the control system 166 may store a most recent target temperature value (e.g., in the memory 168) indicated by the control device 174 when data from the control device 174 is received. As another example, the control system 166 may store multiple target temperature values (e.g., in the memory 168, with a corresponding time stamp for each target temperature value) previously indicated by the control device 174 (e.g., in a time frame during which the data from the control device 174 is received). The control system 166 may reference one or more of the stored target temperature values in the alternative operating mode. For example, based on a determination that the control system 166 does not receive data from the control device 174, the control system 166 may determine an alternative target temperature value for use in the alternative operating mode based on one or more stored target temperature values previously recorded by the control system 166 during earlier operation of the HVAC system 150. In some embodiments, the alternative target temperature value may be a most recently stored target temperature value, an average (e.g., a mathematical mean, median, mode) of multiple stored target temperature values, and/or weighted summation of previous target temperature values recorded by the control system 166.

In the alternative operating mode, the control system 166 may also utilize the alternative target temperature value of the space 152 to enable continued operation of the HVAC system 150 to provide conditioning to the space 152. For example, the sensed temperature of the space 152 received by the first sensor(s) 172 may be compared to the alternative target temperature value of the space 152 when the first sensor(s) 172 are communicatively coupled to the control system 166. The control system may then operate the HVAC system 150 (e.g., the conditioning system 162) to generate the supply air flow 164 and provide the supply air flow 164 to the space 152 to cause the sensed temperature to approach the alternative target temperature value.

Furthermore, in response to a determination that data from each of the first sensor(s) 172 and the control device 174 is not received, the control system 166 may determine both the alternative temperature value of the space 152 and the alternative target temperature value of the space 152. More specifically, based on a determination that the control system 166 does not receive data from both the first sensor(s) 172 and the control device 174, the control system 166 may control operation of the HVAC system 150 (e.g., the conditioning system 162) based on the alternative temperature value of the space 152 and the alternative target temperature value of the space 152 determined in accordance with the techniques described above. For example, the control system 166 may compare the alternative temperature value of the space 152 and alternative target temperature value with one another to determine a desired operation of the HVAC system 150, such as to generate the supply air flow 164 to cause the alternative temperature value of the space 152 to approach the alternative target temperature value. In this way, the control system 166 may enable continued operation of the HVAC system 150 when the control system 166 does not receive data from the first sensor(s) 172 and the control device 174.

During each of the primary operating mode and the alternative operating mode in which the control system 166 operates the HVAC system 150 to adjust a temperature of the space 152 (e.g., a sensed temperature indicated by the first sensor(s) 172, an alternative temperature value determined based on the stored temperature difference value applied to the temperature of the return air flow 160) toward a target temperature of the space 152 (e.g., a target temperature indicated by data received from the control device 174, an alternative target temperature value determined based on previous data received from the control device 174), the control system 166 may initiate operation of the HVAC system 150 based on a call for conditioning (e.g., a call for cooling, a call for heating, a difference between a temperature of the space 152 and a target temperature of the space 152). In some embodiments, the call for conditioning may be determined based on a user input, which may be indicative of a request to operate the HVAC system 150. In additional or alternative embodiments, the call for conditioning may be determined based on a difference between the temperature of the space 152 (e.g., sensed temperature received from first sensor(s) 172 or determined alternative temperature) and a target temperature of the space 152 (e.g., target temperature received from control device 174 or determined alternative target temperature) exceeding a threshold temperature difference, such as two degrees Celsius. In response to the call for conditioning, the control system 166 may operate the HVAC system 150 (e.g., the conditioning system 162) to provide the supply air flow 164 until the temperature of the space 152 is within a threshold temperature difference of the target temperature of the space 152. In response to determining that the temperature of the space 152 is within the threshold temperature difference of the target temperature of the space 152, the control system 166 may determine that the call for conditioning is satisfied and pause or suspend operation of the HVAC system 150 until a subsequent call for conditioning is received.

During operation of the HVAC system 150 in the alternative operating mode, the control system 166 may determine that operation of the HVAC system 150 is to transition to the primary operating mode in response to a determination that data from the first sensor(s) 172 and/or the control device 174 is received after previously not being received. For example, an interrupted communications link between the control system 166 and the first sensor(s) 172 may be reestablished, and the control system 166 may receive data indicative of the sensed temperature of the space 152 from the first sensor(s) 172. Similarly, an interrupted communications link between the control system 166 and the control device 174 may be reestablished, and the control system 166 may receive data indicative of the target temperature of the space 152 from the control device 174. In response, the control system 166 may initiate a transition from operation of the HVAC system 150 in the alternative operating mode to operation in the primary operating mode.

In some embodiments, the control system 166 may monitor a duration of time in which data from the first sensor(s) 172 and/or the control device 174 is not being received (e.g., unavailable). Additionally or alternatively, the control system 166 may monitor a duration of time in which the control system 166 operates the HVAC system 150 in the alternative operating mode. As an example, in response to a determination that data from the first sensor(s) 172 and/or from the control device 174 is unavailable or not received by the control system 166, the control system 166 may initiate a timer 186. In response to the duration of time indicated by the timer 186 exceeding a threshold period of time (e.g., ten minutes, 30 minutes, one hour, more than two hours), the control system 166 may suspend operation of the HVAC system 150 (e.g., in the alternative operating mode) and block re-initiation of operation of the HVAC system 150 (e.g., based on a call for conditioning) until data from the first sensor(s) 172 and/or the control device 174 is available and received by the control system 166. In this manner, the control system 166 may avoid prolonged operation of the HVAC system 150 in the alternative operating mode and/or prompt troubleshooting or maintenance of the HVAC system 150 to reestablish communications between the control system 166 and the first sensor(s) 172 and/or between the control system 166 and the control device 174. The timer 186 may be reset in response to a determination that the data from the first sensor(s) 172 and/or from the control device 174 is received and received by the control system 166 to enable the HVAC system 150 to initiate or re-initiate operation in the primary operating mode. Similarly, the control system 166 may reset the timer 186 in response to transition of HVAC system 150 operation from the alternative operating mode to the primary operating mode.

Figure 6:
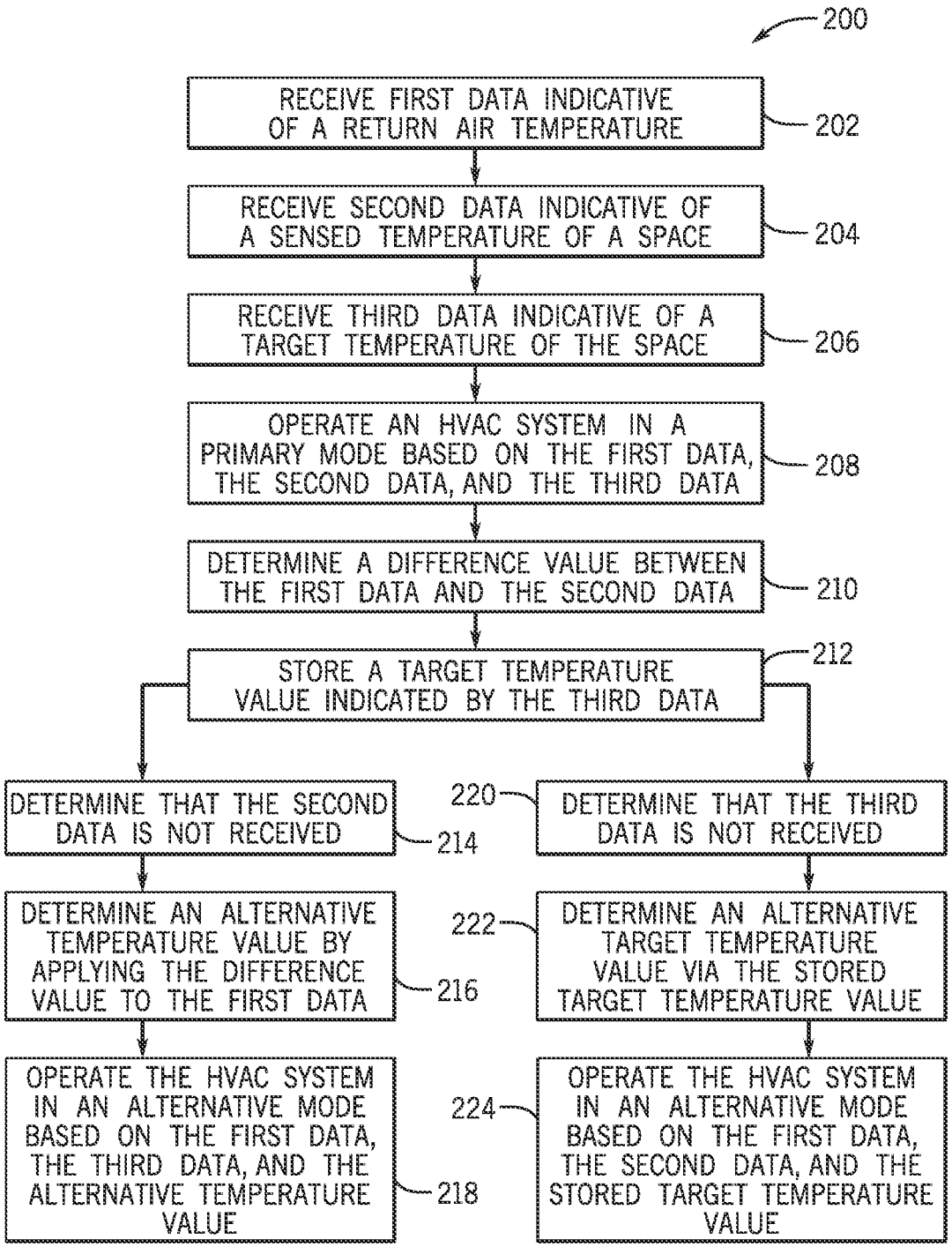
FIG. 6 is a flowchart of an embodiment of a method or process for operating an HVAC system to condition a space, in accordance with an aspect of the present disclosure.

FIG. 6 is an embodiment of a method or process 200 for operating the HVAC system 150, in accordance with the present techniques. In some embodiments, the method 200 and/or one or more of the steps thereof may be performed by a single respective component or system, such as by the control system 166 (e.g., the processing circuitry 170). In additional or alternative embodiments, multiple components or systems may perform the steps for the method 200 (e.g., multiple control systems, separate control systems). It should also be noted that additional steps may be performed as part of the method 200. Moreover, certain steps of the method 200 may be removed, modified, and/or performed in a different order.

At block 202, first data indicative of a temperature of the return air flow 160 is received by the control system 166. As an example, the first data may be received via the second sensor(s) 176 (e.g., the second sensor 176). At block 204, second data indicative of a sensed temperature of the space 152 is received. The second data may be received by the control system 166 via the first sensor(s) 172 disposed within the space 152, for example. In certain embodiments, multiple sensed temperatures of the space 152 may be received (e.g., from multiple first sensors 172) by the control system 166, and an overall or representative sensed temperature of the space 152 may be calculated based on the multiple sensed temperatures, such as a calculation (e.g., a mathematical mean, median, mode, weighted summation) performed by the control system 166. At block 206, third data indicative of a target temperature of the space 152 is received by the control system 166. For instance, the third data may be received via the control device 174. The control device 174 may transmit the third data based on a user input, based on a predetermined setting (e.g., a schedule), and/or based on other inputs or operating parameters of the HVAC system 150.

At block 208, the HVAC system 150 is operated in the primary operating mode based on the first data, the second data, and the third data (e.g., to satisfy a call for conditioning). In the primary operating mode, the control system 166 may regulate operation of the HVAC system 150 to condition or adjust environmental conditions (e.g., temperature) within the space 152. For example, the HVAC system 150 may condition and provide the supply air flow 164 to the space 152 to cause the sensed temperature (e.g., indicated by the second data) to approach the target temperature of the space 152 (e.g., indicated by the third data). In the primary operating mode, the control system 166 may utilize (e.g., compare) the sensed temperature of the space 152 and the target temperature of the space 152 to control the conditioning system 162 to produce the supply air flow 164 supplied to the space 152 and adjust the sensed temperature of the space 152 toward the target temperature of the space 152. The HVAC system 150 may continue to operate in the primary operating mode while the first data, the second data, and the third data are received by the control system 166.

At block 210, the control system 166 may determine a difference value (e.g., temperature difference value, offset value, adjustment factor) between the first data and the second data during operation in the primary operating mode (e.g., while the second data is received by the control system 166 from the first sensor(s) 172). The difference value may be stored by the control system 166 (e.g., in the memory 168) and may be retrievable and/or referenced at a later time. In certain embodiments, multiple difference values may be calculated (e.g., based on multiple sensed temperatures of the space 152 and/or multiple temperatures of the return air flow 160). Additionally or alternatively, a representative difference value (e.g., a single difference value) may be determined by the control system 166 based on multiple determined difference values, such as based on a mathematical mean, median, mode, and/or weighted summation of the difference values. At block 212, the target temperature value of the space 152 may be stored by the control system 166 (e.g., in the memory 168) based on the third data. For example, the stored target temperature value of the space 152 may be based on a most recently indicated target temperature of the space 152 received via the control device 174 and/or based on multiple target temperatures of the space 152 received via the control device 174, such as based on a mathematical mean, median, mode, and/or weighted summation of the target temperatures and/or based on predetermined number of most recent target temperatures.

At block 214, a determination is made that the first data is not received. For example, the control system 166 may determine that a communications link (e.g., a wireless connection) between the control system 166 and the first sensor(s) 172 is interrupted and/or that the control system 166 does not receive the second data from the first sensor(s) 172. In response, at block 216, the control system 166 may determine an alternative temperature value of the space 152 to utilize as a substitute for the sensed temperature of the space 152 previously communicated by the first sensor(s) 172 to enable continued operation of the HVAC system 150. The control system 166 may determine the alternative temperature value by applying (e.g., adding, subtracting, multiplying) the difference value determined via the step performed with respect to block 210 to the first data indicative of the temperature of the return air flow 160. For example, the difference value may be retrieved from the memory 168 and applied to the temperature of the return air flow 160 (e.g., received via the second sensor 176) to generate the alternative temperature value of the space 152 that approximates or represents the sensed temperature of the space 152 (e.g., that would otherwise be indicated by the second data received via the first sensor(s) 172).

At block 218, the control system 166 may operate the HVAC system 150 in an alternative operating mode based on the first data, the third data, and the alternative temperature value of the space 152. Indeed, the alternative temperature value of the space 152 may be used as a substitute for the second data that is not received from the first sensor(s) 172. For example, the control system 166 may operate the HVAC system 150 to produce the supply air flow 164 based on a comparison of the alternative temperature of the space 152 and the target temperature of the space 152 (e.g., indicated via the third data). In this way, the HVAC system 150 may provide the supply air flow 164 to condition the space 152 (e.g., to adjust the alternative temperature of the space toward the target temperature of the space 152) when the control system 166 does not receive the second data from the first sensor(s) 172.

In some embodiments, during the operation in the alternative operating mode, the control system 166 may output an indication (e.g., a notification) indicative of operation in the alternative operating mode. For example, the control system 166 may output a signal indicative of interrupted communication between the control system 166 and the first sensor(s) 172. The indication may include a visual output (e.g., a flashing light, a steady light) and/or an audio output (e.g., a sound, an auditory message) detectable in a vicinity of the HVAC system 150. The indication (e.g., a message) may additionally or alternatively be output to a device (e.g., a mobile phone, a laptop computer, a tablet, a desktop computer) of a user, such as a technician, an operator, and/or a customer. The indication may notify the user of the unavailability of the second data (e.g., communication interruption between the control system 166 and the first sensor(s) 172) and may prompt the user to address the unavailability of the second data in order to enable operation of the HVAC system 150 in the primary operating mode instead of the alternative operating mode.

Additionally or alternatively, a determination is made that the third data is not received, as indicated at block 220. For example, the control system 166 may determine that a communications link between the control system 166 and the control device 174 is interrupted and/or that the control system 166 does not receive the third data from the control device 174. In response, at block 222, the control system 166 may determine an alternative target temperature value to utilize as a substitute for the target temperature of the space 152 previously communicated by the control device 174 to enable continued operation of the HVAC system 150. In some embodiments, the alternative target temperature value may be based on the stored target temperature value (e.g., a previous target temperature received via the control device 174) determined via the step performed with respect to block 212. For instance, the stored target temperature may be retrieved from the memory 168 and designated as the alternative target temperature value.

At block 224, the control system 166 may operate the HVAC system 150 in the alternative operating mode based on the first data, the second data, and the alternative target temperature value of the space 152. That is, the alternative target temperature value of the space 152 may be determined based on the stored target temperature value of the space 152, and the HVAC system 150 may be operated to produce the supply air flow 164 based on the alternative target temperature value of the space 152 and the sensed temperature of the space 152 (e.g., indicated by the second data received from the first sensor(s) 172). For example, the control system 166 may operate the HVAC system 150 to produce the supply air flow 164 based on a comparison of the sensed temperature of the space 152 (e.g., indicated via the second data) and the alternative target temperature value of the space 152. As similarly described above, the control system 166 may also output an indication to notify a user of operation in the alternative operating mode. For example, the output may be a signal indicative of interrupted communication between the control system 166 and the control device 174. The indication may notify a user of the unavailability of the third data and may prompt the user to address the unavailability of the third data in order to enable operation of the HVAC system 150 in the primary operating mode instead of the alternative operating mode.

It should be noted that in some embodiments, certain steps described with respect to the alternative operating mode of the HVAC system 150 may be performed in parallel or at the same time as one another. For instance, the control system 166 may determine that each of the second data and the third data is not received. That is, the control system 166 may determine that the second data and the third data are not received from the first sensor(s) 172 and the control device 174, respectively (e.g., communications links between the control system 166 and the first sensor(s) 172 and between the control system 166 and the control device 174 are interrupted). In response, the control system 166 may determine both the alternative temperature value of the space 152 and the alternative target temperature value of the space 152 in accordance with the techniques described above. That is, the steps described with respect to blocks 214 and 216 and the steps described with respect to blocks 220 and 222 may be performed in parallel with one another based on a determination that the second data and the third data are not received. Accordingly, the control system 166 may operate the HVAC system 150 to produce and provide the supply air flow 164 in the alternative operating mode based on the first data indicative of the temperature of the return air flow 160, the determined alternative temperature value of the space 152, and the determined alternative target temperature value of the space 152. Indeed, the supply air flow 164 may be generated by the HVAC system 150 based on both the determined alternative temperature value of the space 152 and the determined alternative target temperature value of the space 152 (e.g., based on a comparison of the alternative temperature value and the alternative target temperature value).

In certain embodiments, the control system 166 may monitor a duration of time elapsed since a determination that the second data and/or the third data are not received by the control system 166 and/or a duration of time in which the HVAC system 150 is operated in the alternative operating mode. For example, the timer 186 may be initiated when the control system 166 performs the step described with respect to blocks 214 and/or 220. The duration of elapsed time may be determined based on the timer 186. In response to a determination that the duration of elapsed time exceeds a threshold duration of time, the control system 166 may suspend operation of the HVAC system 150. In some embodiments, the control system 166 may not re-initiate operation of the HVAC system 150 until the second data and/or the third data is received by the control system 166. In this manner, prolonged operation of the HVAC system 150 may in the alternative operating mode may be avoided if desired. In some embodiments, in response to a determination that operation of the HVAC system 150 is suspended (e.g., due to the second data and/or the third data not being received by the control system 166) for an additional threshold duration of time, the control system 166 may output an additional indication. The additional indication (e.g., a visual output, an audio output, a notification) may be different than the notification discussed above and may notify a user of suspended operation of the HVAC system 150 in the alternative operating mode. That is, the additional indication may indicate the prolonged unavailability of the second data and/or the third data and may prompt the user to address the unavailability of the second data and/or the third data in order enable the HVAC system 150 to re-initiate operation.

Although FIGS. 5 and 6 described above are primarily directed to conditioning a temperature of a space, the techniques described herein may be used to condition any suitable operating parameter of the space, such as a humidity. That is, in the primary operating mode, the control system 166 may receive (e.g., from respective sensors and/or a control device) data indicative of an operating parameter value of a return air flow, data indicative of a sensed operating parameter value of a space, and/or data indicative of a target operating parameter value of the space. In the primary operating mode, the control system 166 may also calculate a difference value between the operating parameter value of the return air flow and the sensed operating parameter value of the space, and the control system 166 may store the target operating parameter value of the space. In response to the data indicative of the sensed operating parameter value of the space being unavailable (e.g., not received by the control system 166), the control system 166 may operate the HVAC system 150 based on an alternative operating parameter value of the space, which may be calculated by applying the difference value determined during the primary mode to the operating parameter value of the return air flow, as a substitute for the unavailable sensed operating parameter value. Additionally or alternatively, in response to the data indicative of the target operating parameter value being unavailable (e.g., not received by the control system 166), the control system may operate the HVAC system 150 based on an alternative target operating parameter value of the space, which may be determined based on the stored target operating parameter value (e.g., a most recent target operating parameter value) of the space, as a substitute for the unavailable target operating parameter value. In this manner, the control system 166 may operate the HVAC system 150 in the primary operating mode and/or the alternative operating mode to condition any suitable operating parameter of the space.

The present disclosure may provide one or more technical effects useful in the operation of an HVAC system. For example, a control system of the HVAC system may be configured to operate the HVAC system in a primary operating mode based on data indicative of a temperature of a return air flow, data indicative of a sensed temperature of a space serviced by the HVAC system, and data indicative of a target temperature of the space. The control system may also be configured to operate the HVAC system in an alternative operating during periods when the data indicative of the sensed temperature and/or the target temperature is not received by the control system. For example, in response to a determination that the data indicative of the sensed temperature of the space is not received from a sensor, the control system may calculate an alternative temperature value of the space based on a temperature of the return air flow and a difference value (e.g., offset value, adjustment factor) applied to the temperature of the return air flow. The control system may then operate the HVAC system in the alternative operating mode utilizing the alternative temperature value of the space as a substitute for the unavailable data indicative of the sensed temperature of the space. In response to a determination that the data indicative of the target temperature of the space is not received from a control device, the control system may determine an alternative target temperature value of the space based on a stored (e.g., previous) target temperature of the space. The control system may then operate the HVAC system in the alternative operating mode utilizing on the alternative target temperature value as a substitute for the unavailable data indicative of the target temperature of the space. In some instances, the control system may enable operation of the HVAC system utilizing both the alternative temperature value of the space and the alternative target temperature value of the space, such as when the sensed temperature and the target temperature are not received by the control system. Thus, the HVAC system may continue to operate and provide conditioning to the space while the data indicative of the sensed temperature and/or the target temperature of the space is unavailable. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A non-transitory computer-readable medium, comprising instructions stored thereon, wherein the instructions, when executed by processing circuitry, are configured to cause the processing circuitry to:

determine a difference value between a return air flow operating parameter value and a sensed operating parameter value of a space serviced by a heating, ventilation, and/or air conditioning (HVAC) system;

receive a target operating parameter value for the space via a wireless connection;

store the target operating parameter value as a stored target operating parameter value; and operate the HVAC system based on the difference value and based on an alternative target operating parameter value in response to a determination that the wireless connection is unavailable, wherein the alternative target operating parameter value is based on the stored target operating parameter value.

2. The non-transitory computer-readable medium of claim 1, wherein the instructions, when executed by the processing circuitry, are configured to cause the processing circuitry to:

receive the target operating parameter value from a control device, wherein the processing circuitry is configured to communicatively couple to the control device via the wireless connection.

3. The non-transitory computer-readable medium of claim 2, wherein the instructions, when executed by the processing circuitry, are configured to cause the processing circuitry to:

in response to a determination that the wireless connection is available, operate the HVAC system in a primary operating mode and based on the target operating parameter value; and in response to the determination that the wireless connection is unavailable, operate the HVAC system in an alternative operating mode and based on the alternative target operating parameter value.

4. The non-transitory computer-readable medium of claim 2, wherein the alternative target operating parameter value is a most recent target operating parameter value for the space received from the control device or a calculated target operating parameter value determined based on a mean of multiple stored target operating parameter values, a mode of the multiple stored target operating parameter values, or a weighted summation of the multiple stored target operating parameter values.

5. The non-transitory computer-readable medium of claim 1, wherein the instructions, when executed by the processing circuitry, are configured to cause the processing circuitry to:

receive data indicative of the sensed operating parameter value from a sensor disposed within the space, wherein the processing circuitry is configured to communicatively couple to the sensor via an additional wireless connection.

6. The non-transitory computer-readable medium of claim 5, wherein the instructions, when executed by the processing circuitry, are configured to cause the processing circuitry to operate the HVAC system based on the difference value and an alternative operating parameter value in response to a determination that the additional wireless connection is unavailable, wherein the alternative operating parameter value is based on the return air flow operating parameter value and the difference value.

7. The non-transitory computer-readable medium of claim 6, wherein the instructions, when executed by the processing circuitry, are configured to cause the processing circuitry to:

apply the difference value to the return air flow operating parameter value to determine the alternative operating parameter value; and operate the HVAC system based on the alternative operating parameter value.

8. A non-transitory computer-readable medium, comprising instructions stored thereon, wherein the instructions, when executed by processing circuitry, are configured to cause the processing circuitry to:

determine a difference value between a return air flow operating parameter value and a first sensed operating parameter value of a space configured to be conditioned by a heating, ventilation, and/or air conditioning (HVAC) system;

in response to a determination that a second sensed operating parameter value of the space is not received, determine an alternative operating parameter value based on the difference value; and operate the HVAC system based on the alternative operating parameter value in response to the determination that the second sensed operating parameter value of the space is not received.

9. The non-transitory computer-readable medium of claim 8, wherein the instructions, when executed by the processing circuitry, are configured to cause the processing circuitry to:

receive first data indicative of the return air flow operating parameter value from a first sensor of the HVAC system, wherein the processing circuitry is configured to communicatively couple to the first sensor via a hardwired connection; and receive second data indicative of the first sensed operating parameter value of the space from a second sensor of the HVAC system, wherein the processing circuitry is configured to communicatively couple to the second sensor via a wireless connection.

10. The non-transitory computer-readable medium of claim 9, wherein the instructions, when executed by the processing circuitry, are configured to cause the processing circuitry to:

receive third data indicative of a target temperature associated with the space from a control device;

apply the difference value to the return air flow operating parameter value to determine the alternative operating parameter value; and operate the HVAC system based on a comparison of the alternative operating parameter value and the target temperature associated with the space in response to a determination that the wireless connection is unavailable.

11. The non-transitory computer-readable medium of claim 9, wherein the instructions, when executed by the processing circuitry, are configured to cause the processing circuitry to:

receive third data indicative of a target temperature associated with the space from a control device;

receive additional data indicative of a plurality of sensed operating parameter values from a plurality of additional second sensors, wherein the processing circuitry is configured to wirelessly communicatively couple to each additional second sensor of the plurality of additional second sensors;

determine the alternative operating parameter value based on the additional data in response to a determination that the second sensed operating parameter value of the space is not received from the second sensor; and operate the HVAC system based on a comparison of the alternative operating parameter value and the target temperature associated with the space in response to the determination that the second sensed operating parameter value of the space is not received from the second sensor.

12. The non-transitory computer-readable medium of claim 11, wherein each additional second sensor of the plurality of additional second sensors is associated with a respective additional space configured to be conditioned by the HVAC system.

13. The non-transitory computer-readable medium of claim 11, wherein the instructions, when executed by the processing circuitry, are configured to cause the processing circuitry to determine the alternative operating parameter value based on a mean of the plurality of sensed operating parameter values, a mode of the plurality of sensed operating parameter values, or a median of the plurality of sensed operating parameter values.

14. The non-transitory computer-readable medium of claim 8, wherein the instructions, when executed by the processing circuitry, are configured to cause the processing circuitry to:

receive a target operating parameter value of the space from a control device;

store the target operating parameter value of the space in a memory as a stored target operating parameter value;

in response to a determination that an additional target operating parameter value of the space is not received from the control device, determine an alternative target operating parameter value of the space based on the stored target operating parameter value of the space; and operate the HVAC system based on the alternative target operating parameter value in response to the determination that the additional target operating parameter value of the space is not received from the control device.

15. The non-transitory computer-readable medium of claim 14, wherein the instructions, when executed by the processing circuitry, are configured to cause the processing circuitry to operate the HVAC system based on a comparison of the alternative operating parameter value of the space and the alternative target operating parameter value in response to the determination that the second sensed operating parameter value is not received and the determination that the additional target operating parameter value is not received.

16. A control system comprising:

processing circuitry; and a memory comprising instructions stored thereon, wherein the instructions, when executed by the processing circuitry, are configured to cause the processing circuitry to:

store, in the memory, a difference value indicative a difference between an operating parameter value of a return air flow received by a heating, ventilation, and/or air conditioning (HVAC) system and a sensed operating parameter value associated with a space conditioned by the HVAC system;

store, in the memory, a target operating parameter value associated with the space as a stored target operating parameter value; and operate the HVAC system based on an alternative operating parameter value derived via the difference value in response to a first determination that an additional sensed operating parameter value is not received, based on an alternative target operating parameter value derived via the stored target operating parameter value in response to a second determination that an additional target operating parameter value is not received, or both.

17. The control system of claim 16, wherein the instructions, when executed by the processing circuitry, are configured to cause the processing circuitry to:

operate the HVAC system in a primary operating mode based on the sensed operating parameter value, the operating parameter value of the return air flow, and the target operating parameter value; and operate the HVAC system in an alternative operating mode based on the alternative operating parameter value in response to the first determination, based on the alternative target operating parameter value in response to the second determination, or both.

18. The control system of claim 17, wherein the instructions, when executed by the processing circuitry, are configured to cause the processing circuitry to:

apply the difference value to the operating parameter value of the return air flow to determine the alternative operating parameter value in response to the first determination; and operate the HVAC system based a comparison of the alternative operating parameter value and the additional target operative parameter value in the alternative operating mode.

19. The control system of claim 17, wherein the instructions, when executed by the processing circuitry, are configured to cause the processing circuitry to:

monitor a duration of time associated with operation of the HVAC system in the alternative operating mode; and suspend operation of the HVAC system in response to a determination that the duration of time exceeds a threshold duration of time.

20. The control system of claim 19, wherein the instructions, when executed by the processing circuitry, are configured to cause the processing circuitry to:

output an indication indicative of operation of the HVAC system in the alternative operating mode or indicative of suspended operation of the HVAC system.

* * * * *